United States Patent [19]

Dietrich

[11] Patent Number: 4,813,724

[45] Date of Patent: Mar. 21, 1989

[54] SELF-ADJUSTING DOOR STRIKE

[75] Inventor: Hagen Dietrich, Delta, Canada

[73] Assignee: Masco Building Products Corp., Taylor, Mich.

[21] Appl. No.: 9,434

[22] Filed: Feb. 2, 1987

[51] Int. Cl.[4] ..... F05B 15/02

[52] U.S. Cl. ..... 292/341.12; 272/DIG. 73; 272/341.18

[58] Field of Search ..... 292/DIG. 56, DIG. 73, 292/341.12, 341.13, 341.18, 341.19

[56] References Cited

U.S. PATENT DOCUMENTS

| | | | |
|---|---|---|---|
| 201,572 | 3/1878 | Taylor | 292/341.18 |
| 353,263 | 11/1886 | Lungen . | |
| 417,845 | 12/1889 | Stone | 292/341.13 |
| 539,969 | 5/1895 | Wells . | |
| 879,811 | 2/1908 | Burgess | 292/DIG. 73 |
| 964,265 | 7/1910 | Johnson . | |
| 1,089,193 | 3/1914 | Ervien | 292/DIG. 73 |
| 1,098,393 | 6/1914 | O'Brien | 292/DIG. 73 |
| 1,180,814 | 4/1916 | Ziganek . | |
| 1,186,315 | 4/1916 | Holland . | |
| 1,194,637 | 8/1916 | Joy | 292/DIG. 73 |
| 1,265,351 | 5/1918 | Menier . | |
| 1,287,606 | 12/1918 | Allmand | 292/DIG. 73 |
| 1,305,212 | 5/1919 | Hitchcock | 292/DIG. 73 |
| 1,318,382 | 10/1919 | Herby | 292/DIG. 73 |
| 1,318,988 | 10/1919 | Good . | |
| 1,323,783 | 12/1919 | Mumbrauer . | |
| 1,588,026 | 6/1926 | Hill . | |
| 1,829,916 | 11/1931 | Winans | 292/DIG. 73 |
| 1,875,453 | 9/1932 | Haskins | 292/341.12 |
| 1,886,494 | 11/1932 | Mitchell | 292/341.12 |
| 2,389,056 | 11/1945 | Jamison, Jr. | 292/341.18 |
| 2,446,206 | 8/1948 | Beckman . | |
| 2,541,720 | 2/1951 | Robinson . | |
| 2,604,343 | 7/1952 | Fredholm . | |
| 2,869,913 | 1/1959 | Schlage | 292/341.12 |
| 2,993,719 | 7/1961 | Manchester | 292/341.18 |
| 3,006,677 | 10/1961 | Royalty | 292/341.18 |
| 3,245,709 | 4/1966 | Rosenberger | 292/341.18 |
| 3,287,055 | 11/1966 | Schlage . | |
| 3,371,948 | 3/1968 | Velavilius | 292/DIG. 55 |
| 3,645,516 | 2/1972 | Robertson . | |
| 4,022,504 | 5/1977 | Andersen . | |
| 4,597,599 | 7/1986 | Bisbing | 292/DIG. 51 |

FOREIGN PATENT DOCUMENTS

| | | | |
|---|---|---|---|
| 218071 | 6/1910 | Fed. Rep. of Germany | 292/341.13 |
| 2355978 | 2/1978 | France | 292/341.12 |
| 2534305 | 4/1984 | France | 292/DIG. 73 |
| 419818 | 11/1934 | United Kingdom | 292/341.12 |

*Primary Examiner*—Gary L. Smith
*Assistant Examiner*—Eric K. Nicholson
*Attorney, Agent, or Firm*—Edgar A. Zarins; Leon E. Redman; Steven L. Permut

[57] ABSTRACT

A self-adjusting door strike for a bolt assembly which adjusts to existing door conditions by deflecting a resilient member against the bolt of the door thereby eliminating rattle. The strike includes a conventional strike plate having a compensating member spanning the strike opening. The resilient compensating member can be in the form of a resilient plastic member or rollers axially mounted to a spring-wire. This compensating member engages the bolt to prevent the door and bolt mechanism from rattling within the strike while also compensating for shrinkage or warping of the door.

5 Claims, 2 Drawing Sheets

SELF-ADJUSTING DOOR STRIKE

BACKGROUND OF THE INVENTION

I. Field of the Invention

This invention relates to bolt strikes for door lock mechanisms and, in particular, to a door-strike which includes a compensating member to eliminate door rattle while preventing excessive tightness resulting from fluctuations in the shape of the door.

II. Description of the Prior Art

Strike plates have long been utilized to facilitate smooth mating between the latch bolt of the door lock and the mating receptacle formed in the jamb of the door frame. Typically, the strike plate includes a forward camming lip which gradually forces the bolt inwardly until it reaches a mating aperture formed in the strike plate. Generally, this aperture is positioned over a receiving cavity formed in the door jamb although strike plates have been developed which include integrally formed receptacles extending from the rear face of the strike plate. Proper clearance between the edge of the door and the face of the strike plate ensures adequate depression of the bolt as the door is closing while positioning of the central aperture ensures full extension of the latch bolt upon engagement. Thus, proper clearance for the bolt within the central opening is necessary for full extension of the bolt while facilitating ease of opening the latch by minimizing the friction therebetween.

As a result of the necessity to maintain proper clearance for insertion of the latch bolt, the latch bolt may rattle within the central opening of the strike plate. Strike plates have been developed to eliminate the rattle by including projections which extend from the latch bolt receptacle of the strike plate against the flat edge of the bolt. Generally, these devices are manually adjusted to fixedly position the projection against the door bolt upon installation of the striker plate. Another prior known method of eliminating rattle is to include adjustment screws that permit the strike to be slidably adjusted to a fixed position according to present requirements. However, both of these methods can prove cumbersome when temperature and moisture differences between the outside and inside of the door cause it to continually change its shape through warpage and shrinkage.

SUMMARY OF THE PRESENT INVENTION

The present invention overcomes the disadvantages of the prior known strike plates by providing a self-adjusting door strike adapted to firmly receive the latch bolt thereby eliminating rattle and excessive pressure upon the bolt despite varying environmental conditions.

The strike plate according to the present invention includes a camming lip which engages the latch bolt and forces it inwardly until it passes over a similarly configured central aperture through which it can extend. The plate is provided with a plurality of mounting holes to facilitate mounting to the frame of the door. Typically, the plate is mounted to the door jamb over a receiving cavity drilled or cut into the jamb and configured to receive the latch bolt.

In order to compensate for variations in the relative positions of the bolt and the strike receptacle, a biasing member is provided which engages the bolt upon extension thereof through the receiving aperture. In this manner, no adjustment of the strike is necessary to maintain engagement against the door bolt even after a horizontal shift of the door relative to the frame. The biasing member can be in the form of a curved plastic arm secured to the rear face of the strike plate and extending across one portion of the receiving aperture. Preferably, the ends of the band are slidably secured to the upper and lower portions of the plate such that when the latch bolt engages the apex of the curved plastic member, the ends are forced outwardly to compensate for the pressure upon the biasing member. Alternatively, the ends of the biasing member can be fixedly secured such that the material properties of the plastic spanning member compensate for the pressure caused by the latch bolt. In a still further embodiment, a roller and spring wire assembly can be utilized as the biasing member.

Other objects, features and advantages of the present invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to the parts throughout the views, and in which.

DETAILED DESCRIPTION OF A PREFERRED EMBODIMENT OF THE PRESENT INVENTION

Figure 3:
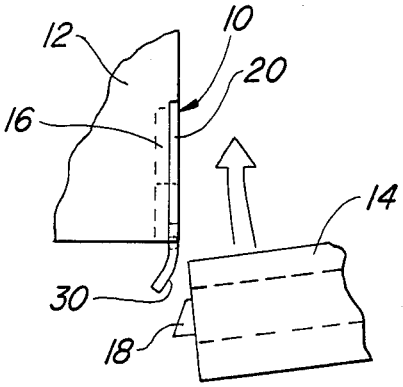
FIG. 3 is a top perspective of the door strike mounted to a door frame and showing the cooperation thereof with the latch assembly of the door.
Figure 8:
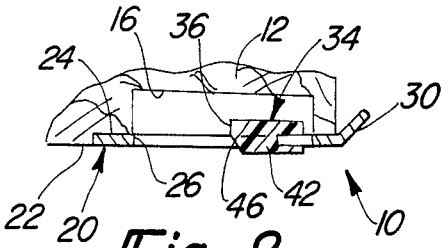
FIG. 8 is a partial cross-sectional perspective taken along line 8—8 of FIG. 7.

Referring first to Figures through 8 of the drawings, there is shown a self-adjusting door strike 10 designed to maintain an optimum alignment between the latch bolt of the door and the receiving cavity of the door frame thereby eliminating annoying rattle and tight door situations. As shown in FIGS. 3 and 8, the door strike 10 is adapted to be mounted to the frame 12 of the door opening in such a position as to engage the closure mechanism of the door 14 hingedly mounted to the door frame. Preferably, the strike 10 is mounted flush with the door frame 12 to provide proper clearance upon closing the door 14. Also formed in the door frame is a receiving cavity 16 adapted to receive the latch bolt 18 of the door lock mechanism.

Figure 1:
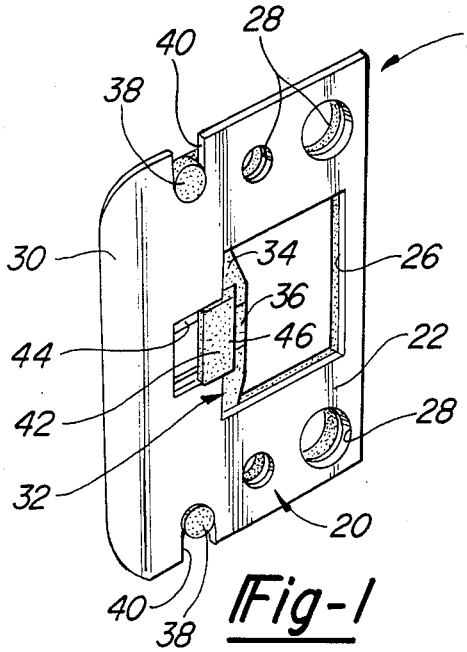
FIG. 1 is a front elevated perspective of a first embodiment of the door strike according to the present invention.
Figure 2:
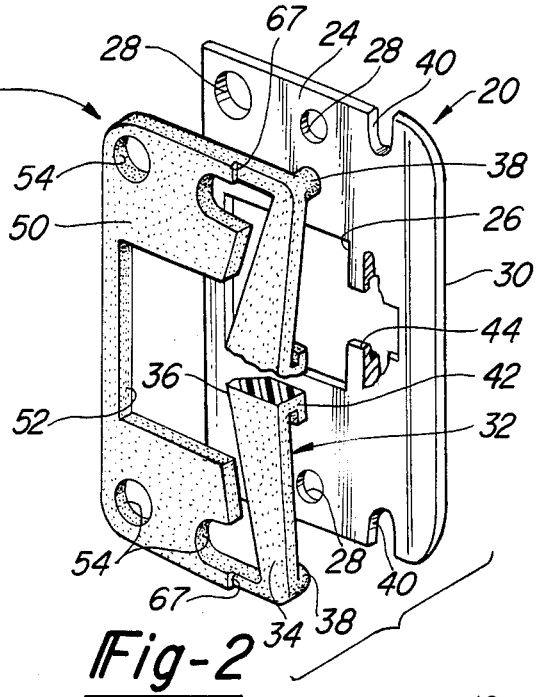
FIG. 2 is an exploded rear view of the door strike.

Referring now to FIGS. 1 and 2, the door strike 10 comprises a plate member 20 having a front face 22 and a rear face 24. Moreover, the plate 20 includes a central opening 26 adapted to receive the latch bolt 18 therethrough. The opening 26 has a configuration closely conforming to the shape of the latch bolt 18 in order to provide proper engagement and is mounted over the receiving cavity 16 formed in the door frame 12 in order to allow full extension of the latch bolt 18. The plate 20 also includes a plurality of mounting apertures 28 which facilitate mounting of the strike 10 to the door frame 12 utilizing standard screws or rivets. Moreover, as is well known in the art, the plate member 20 may include a camming lip 30 for preliminarily engaging the latch bolt 18 upon closure of the door 14.

Figure 4:
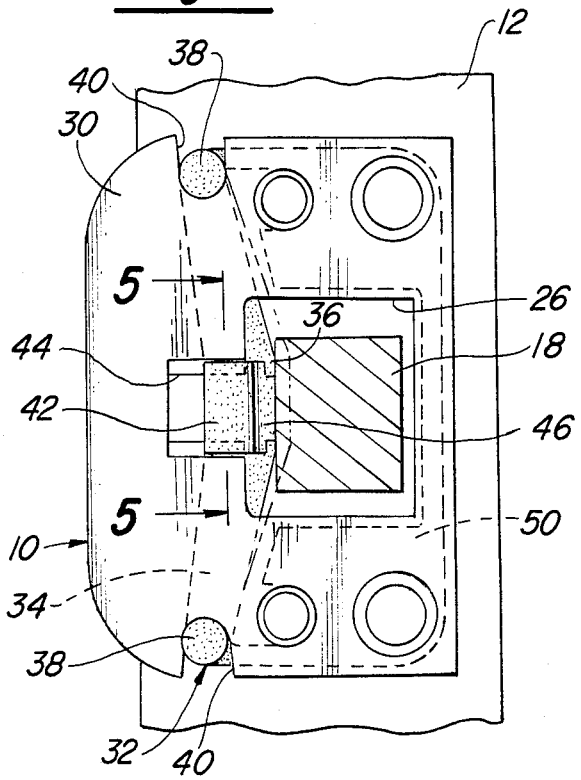
FIG. 4 is a front plan view of the door strike mounted to a door frame.
Figure 5:
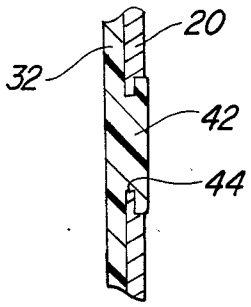
FIG. 5 is a partial cross-sectional perspective taken along line 5—5 of FIG. 4.
Figure 7:
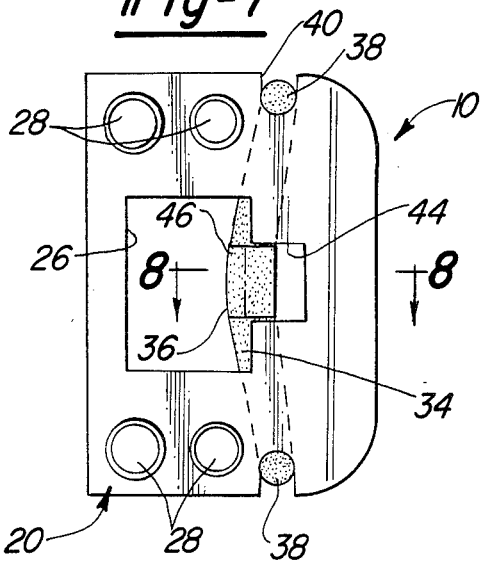
FIG. 7 is a front plan view of the embodiment of FIG. 6.

Attached to the rear face 24 of the plate member 20 is a resilient biasing member 32. In one embodiment of the door strike 10, the biasing member 32 comprises a generally curved arm 34 extending substantially vertically across the plate 20. The arm 34 includes an intermediate apex 36 and means for slidably attaching the ends of the arm 34 to the plate member 20. The arm 34 is mounted to the plate 20 in such a manner so that the apex 36 of the arm 34, at least partially, extends across the opening 26 of the plate 20 to engage the flat front side of the latch bolt 18 upon extension thereof through the opening 26 as best shown in FIGS. 4 and 7. Operation of the present invention will be described in greater detail below.

In order to maintain proper positioning of the biasing member 32, the ends of the arm 34 are provided with pegs 38 which are received within vertical slots 40 formed at the top and bottom of the plate 20. The slots 40 allow the ends of the arm 34 to slidably move vertically upon forward movement of the arm 34 caused by engagement of the latch bolt 18. To ensure smooth horizontal movement of the arm apex 36, the arm 34 includes an alignment tongue 42 integrally formed therewith. The tongue 42 is received by a guide notch 44 formed in the plate member 20. In the preferred embodiment, the guide notch 44 extend from a forward edge of the central opening 26. Moreover, the alignment tongue 42 includes a sloped surface 46 extending from the front face of the tongue 42 to the apex 36 of the biasing arm 34 in order to faciliate proper engagement with the latch bolt 18.

Figure 6:
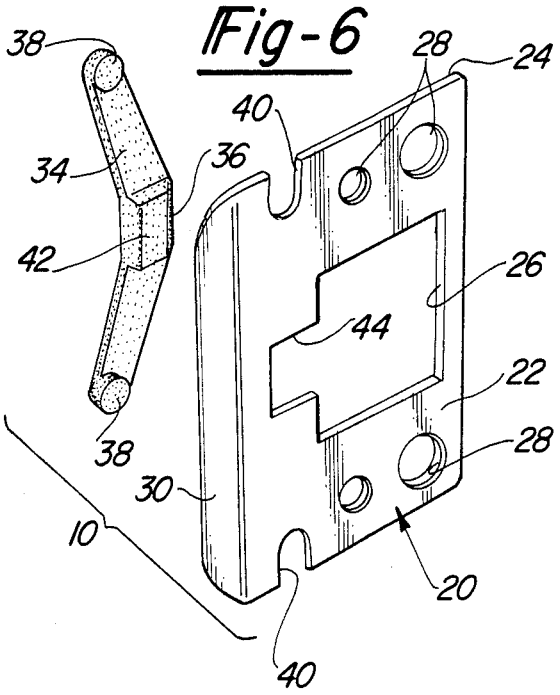
FIG. 6 is a front elevated perspective of another embodiment of the door strike according to the present invention.

Although the biasing arm 34 can be independently supported by the alignment tongue 42 and the pegs 38 as shown in FIGS. 6 and 7, additional means such as an integrally formed support frame 50 (FIG. 2), with a surface that protrudes past the biasing member 32 as shown by edges 67, may be included to strengthen the overall structure and to allow for simpler preparation of the door frame 12 prior to mounting strike 10 to the door frame 12. The support frame 50 has a substantially rectangular configuration with a central opening 52 aligned with the opening 26 in the plate member 20. Upon mounting of the strike 10, the integrally formed frame 50, which is thicker than the arm 34, is sandwiched between the plate 20 and the frame 12 of the door thereby freeing arm 34 so that the resiliency of the biasing member 32 remains unimpeded. The frame 50 includes a plurality of mounting apertures 54 adapted to receive the mounting screws for the strike 10. In both the embodiment of FIG. 2 and the embodiment of FIGS. 6 and 7, the biasing member 32 is made from a plastic material having sufficient resiliency to be biased by the latch bolt 18 under varying conditions and a low coefficient of friction to prevent jamming caused by excessive friction against the bolt 18 which would inhibit full extension of the bolt 18 into the cavity 16.

Figure 9:
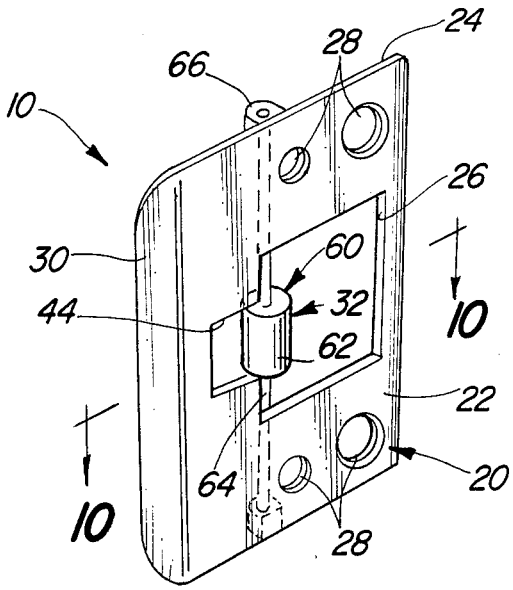
FIG. 9 a front elevated perspective of a still further embodiment of the door strike according to the present invention.
Figure 10:
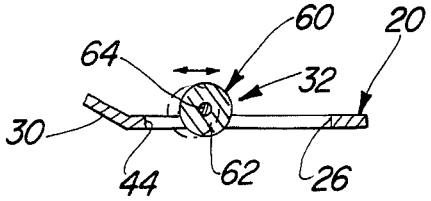
FIG. 10 is a partial cross-sectional perspective taken along line 10—10 of FIG. 9.

In a still further embodiment shown in FIGS. 9 and 10, the biasing member 32 comprises a spring-wire and roller assembly 60 secured to the rear face 24 of the plate member 20. The assembly 60 includes at least one roller 62 rotatably and axially mounted to a flexible wire 64. The opposite ends of the wire 64 are fixedly attached by any known means to the rear face 24 of the plate 20. The assembly 60 is mounted such that the roller 62 extends at least partially across the opening 26 to engage the bolt 18 extending therethrough. The resiliency of the assembly 60 is provided by the flexibility of the spring-wire 64 while any friction resulting from the engagement can be overcome by the rotation of the roller 62.

Operation of the present invention eliminates door rattle caused by excessive clearance between the latch bolt 18 and the edges of the receiving cavity 16 while also preventing jamming caused by insufficient clearance. Upon mounting the strike 10 to the door frame 12 such that the biasing member 32 is sandwiched between the plate member 20 and the frame 12, the biasing member 32 will extend at least partially into the receiving cavity 16. As the door 14 is closed in the direction of the arrow shown in FIG. 3, the bolt 18 will engage the camming lip 30 of the plate member 20 and be gradually forced inwardly. As the door 14 is completely closed, the bolt 18 will travel over the biasing member 32 and fully extend into the receiving cavity 16. In the embodiments of FIGS. 1 through 8, the bolt 18 will travel down the sloped surface 46 thereby biasing the apex 36 of the arm 34 forwardly towards the camming lip 30. Thus, the arm 34 will move from its at rest position shown in phantom in FIG. 4 to the biasing position shown in solid therein. In this manner the bolt 18 will be positionally captured between the apex 36 of the biasing member 32 and the opposing edge of the central opening 26. Upon retraction of the bolt 18 the arm 34 will return to its at rest position. The tension exerted by the biasing member 32 varies depending upon the embodiment, particularly the support structure for the arm 34. In the embodiment of FIGS. 6 and 7, the pegs 38 are free to move outwardly in the slots 40. In contrast, the support frame 50 of the embodiment of FIGS. 1 and 2 inhibits this outward movement thereby creating a greater tension. Accordingly, the appropriate embodiment can be utilized depending upon the weight of the door and the frequency of use. In addition, the support frame 50 simplifies door frame preparation prior to installation of the strike 10.

The embodiment of FIGS. 9 and 10 operates under a similar principle to compensate for variations in the clearance for the bolt 18 within the receiving cavity 16. The ends of the spring-wire 64 are free to move axially within their retainers 66 in order to compensate for the lateral movement of the roller 62. In addition, the rotational movement of the roller 62 prevents the bolt 18 from jamming due to excessive force applied by the biasing member 32.

The foregoing detailed description has been given for clearness of understanding only and no unnecessary limitations should be understood therefrom as some modifications will be obvious to those skilled in the art without departing from the scope and spirit of the appended claims.

I claim:

1. A door strike for biasingly receiving a longitudinally extendable latch bolt of a door lock mechanism to compensate for clearance variations between the door lock mechanism and the door strike, said door strike comprising:

a plate member having rear and front faces and means for mounting said plate member to the frame of the door in alignment with the door lock mechanism, said plate member having a central opening adapted to receive the longitudinally extending latch bolt and at least one slot; and a resilient biasing member attached to the rear face of said plate member, said biasing member including an elongated arm having an intermediate apex and opposite ends, said ends of said arm including pegs attaching said biasing member to said plate member, one of said pegs slidably received in said at least one slot, and said apex including an alignment tongue extending into said central opening of said plate member, at least a portion of said apex extending across said central opening to biasingly engage the latch bolt upon extension of the bolt through said central opening.

2. A door strike for biasingly receiving a latch bolt of a door lock mechanism, said door strike comprising:

a plate member having rear and front faces and a plurality of apertures for mounting said plate member to the frame of the door in alignment with the door lock mechanism, said plate member having a central opening adapted to receive the latch bolt, said central opening including a guide notch extending therefrom; and a resilient biasing member attached to the rear face of said plate member, said biasing member including an elongated arm having an intermediate apex and opposite ends, said ends of said arm being slidably attached to said plate member and at least a portion of said intermediate apex of said arm extending across said central opening of said plate member such that said ends of said arm are biased outwardly as said apex biasingly engages the latch bolt upon extension of the bolt through said central opening, said arm including an integral alignment tongue formed proximate said apex, said alignment tongue slidably received in said guide notch to laterally guide said apex of said arm upon engagement with the latch bolt.

3. The door strike as defined in claim 2 wherein said ends of said arm include pegs, said pegs being received in slots formed at the top and bottom of said plate member, said slots adapted to slidably receive said pegs of said arm such that the ends of said arm slide outwardly along said slot upon engagement of the latch bolt with said apex of said arm.

4. The door strike as defined in claim 3 wherein said biasing member further comprises a rectangular support frame integrally formed with said elongated arm, said integral support frame and arm being disposed between said plate member and the frame of the door upon mounting of the door strike.

5. A door strike for biasingly receiving a latch bolt of a door lock mechanism, said door strike comprising:

a plate member having rear and front faces and plurality of apertures for mounting said plate member to the frame of the door in alignment with the door lock mechanism, said plate member having a central opening adapted to receive the latch bolt and slots formed at the top and bottom of said plate member, said central opening including a guide notch extending therefrom;

a resilient biasing member attached to the rear face of said plate member, said biasing member including a rectangular support frame integrally formed with an elongated arm having an intermediate apex and opposite ends, said ends including pegs slidably received in said slots of said plate member and at least a portion of said intermediate apex of said arm extending across said central opening, said arm including an integral alignment tongue formed proximate said apex and slidably received in said guide notch to laterally guide said apex of said arm upon engagement with the latch bolt, said ends of said arm being biased outwardly as said apex biasingly engages the latch bolt upon extension of the bolt through said central opening.

* * * * *